US011969071B2

(12) United States Patent
Hang

(10) Patent No.: US 11,969,071 B2
(45) Date of Patent: Apr. 30, 2024

(54) ALL-ALUMINUM LIPSTICK TUBE CARTRIDGE AND LIPSTICK TUBE

(71) Applicant: NINGBO JINYU TECHNOLOGY INDUSTRY CO., LTD., Ningbo (CN)

(72) Inventor: Cheng Hang, Ningbo (CN)

( * ) Notice: Subject to any disclaimer, the term of this patent is extended or adjusted under 35 U.S.C. 154(b) by 0 days.

(21) Appl. No.: 17/624,269

(22) PCT Filed: Oct. 28, 2021

(86) PCT No.: PCT/CN2021/127056

§ 371 (c)(1),
(2) Date: Dec. 31, 2021

(87) PCT Pub. No.: WO2022/166274

PCT Pub. Date: Aug. 11, 2022

(65) Prior Publication Data

US 2023/0363512 A1 Nov. 16, 2023

(30) Foreign Application Priority Data

Feb. 2, 2021 (CN) ..... 202110144520.X

(51) Int. Cl.
*A45D 40/06* (2006.01)
*A45D 40/00* (2006.01)
*A45D 40/12* (2006.01)

(52) U.S. Cl.
CPC ..... *A45D 40/06* (2013.01); *A45D 40/12* (2013.01); *A45D 2040/0025* (2013.01)

(58) Field of Classification Search
CPC ..... A45D 40/06; A45D 40/12; A45D 2040/0025; A45D 40/00; A45D 40/02; A45D 40/04; A45D 40/205
USPC ..... 401/77, 78, 88
See application file for complete search history.

(56) References Cited

U.S. PATENT DOCUMENTS

| | | | | | |
|---|---|---|---|---|---|
| 3,153,479 | A * | 10/1964 | Hultgren | A45D 40/06 | 401/78 |
| 5,871,295 | A * | 2/1999 | Bouix | A45D 40/06 | 401/86 |
| 6,139,208 | A * | 10/2000 | Monin-Bareil | A45D 40/06 | 401/78 |
| 11,633,031 | B2 * | 4/2023 | Lin | A45D 40/02 | 206/385 |
| 2005/0286964 | A1 * | 12/2005 | Boulogne | A45D 40/12 | 401/61 |
| 2022/0338607 | A1 * | 10/2022 | Zhu | A45D 40/06 | |

* cited by examiner

*Primary Examiner* — David J Walczak
(74) *Attorney, Agent, or Firm* — Jose Cherson Weissbrot

(57) ABSTRACT

An all-aluminum lipstick tube cartridge comprises a sleeve portion, a spiral portion, an inner body portion and a cup portion, wherein the inner side wall of the spiral portion is formed with a helical spiral groove. A head end of the spiral groove is located at the upper end of the spiral portion and a tail end of the spiral groove is located at the lower end of the spiral portion, and a side wall of the inner body portion is provided with a pair of oppositely formed guide slots axially formed along the inner body portion.

7 Claims, 8 Drawing Sheets

ALL-ALUMINUM LIPSTICK TUBE CARTRIDGE AND LIPSTICK TUBE

TECHNICAL FIELD

The present invention relates to the technical field of lipstick tubes, in particular to an all-aluminum lipstick tube cartridge and a lipstick tube.

BACKGROUND

A finished product of a lipstick tube usually includes a cap, a cartridge and an outer base. The cartridge includes a sleeve portion, a spiral portion, an inner body portion and a cup portion sleeved in sequence from outside to inside. The cup portion is sleeved on the inner side of the inner body portion, and the cup portion is used for placing a lipstick paste body. The assembled cartridge is sleeved into the outer base of the lipstick tube and is then matched with the cap to assemble the finished product of the lipstick tube. Therefore, the cartridge becomes an important core part of the lipstick tube.

However, there are some problems on the lipstick tube cartridges in the existing market: it is not simple enough to assemble the cartridges in integral structure, and even the cartridges are assembled by using gum bodies. Moreover, when the existing cartridge is applied to the lipstick tube, the assembling fit degree among the sleeve portion, the inner body portion, the cup portion and the spiral portion of the cartridge is poor, and there is a problem that a twisting force is not stable enough. Meanwhile, accessories of the lipstick tube in the existing market are formed by various materials and are then assembled, so that great difficulty to recover and scrap the accessories is increased.

SUMMARY

In order to solve a first technical problem of the present invention, the present invention aims to provide an all-aluminum lipstick tube cartridge.

In order to solve a second technical problem of the present invention, the present mention aims to provide a lipstick tube applying the all-aluminum lipstick tube cartridge.

The technical scheme adopted by the present invention to solve the first technical problem is as follows: an all-aluminum lipstick tube cartridge, including:

a sleeve portion provided with a first cavity, a spiral portion sleeved in the first cavity of the sleeve portion, the spiral portion being provided with a second cavity; an inner side wall of the spiral portion being formed with a helical spiral groove, a head end of the spiral groove being located at the upper end of the spiral portion and a tail end of the spiral groove being located at the lower end of the spiral portion;

an inner body portion sleeved in the second cavity of the spiral portion, the inner body portion being provided with a third cavity, a side wall of the inner body portion being provided with a pair of oppositely formed guide slots axially formed along the inner body portion, a head end and a tail end of each of the guide slots being formed with a notch communicated with the guide slot; and a cup portion rotatably sleeved in the third cavity of the inner body portion, the cup portion being provided with a fourth cavity; an outer side wall of the cup portion being provided with at least one convex pin, the convex pins penetrating through the guide slot in the same side and being slidably arranged in the spiral groove, the convex pins being capable of sliding back and forth between the guide slot and the corresponding notch, wherein the sleeve portion and the inner body portion are assembled together via sliding connection structures matched with each other, and the sleeve portion, the spiral portion, the inner body portion and the cup portion are all all-aluminum parts.

As an improvement, in the all-aluminum lipstick tube cartridge, the lower end of the sleeve portion and the lower end of the inner body portion are provided with the sliding connection structures matched with each other.

Further, in the all-aluminum lipstick tube cartridge, the lower end of the sleeve portion is formed with a turned edge turning toward the inner side of the first cavity, and the lower end of the inner body portion is formed with a convex ring portion in buckling fit with the turned edge.

As a further improvement, in the all-aluminum lipstick tube cartridge, the inner side wall located on the cup portion and formed on the fourth cavity is provided with at least one inclined diagonal rib, a head end of the diagonal rib is arranged on the inner side wall, and a tail end of the diagonal rib is located in the fourth cavity.

As an improvement, in the all-aluminum lipstick tube cartridge, the upper end of the inner body portion is formed with at least one groove opening slips into, and the groove opening is communicated with the guide slot in the same side.

Further, in the all-aluminum lipstick tube cartridge, an outer side wall of the lower end of the inner body portion is formed with several first rotation stopping ribs.

Yet further, in the all-aluminum lipstick tube cartridge, an inner side wall of the lower end of the inner body portion is formed with several second rotation stopping ribs.

As a further improvement, in the all-aluminum lipstick tube cartridge, the guide slots and the notches respectively communicated with the guide slots are integrally Z-shaped.

The technical scheme adopted by the present invention to solve the second technical problem is as follows: a lipstick tube applying the all-aluminum lipstick tube cartridge.

Compared with the prior art, the present invention has the advantages that

First of all, in the lipstick tube cartridge of the present invention, the convex pins are arranged on the cup portion, are enable to penetrate through the corresponding guide slots and are arranged in the spiral groove in the corresponding side, so that sliding connections between the cup portion and the inner body portion and between the cup portion and the spiral portion are realized respectively. The sleeve portion and the cup portion realize a sliding connection assembling effect between the sleeve portion and the cup portion by buckling fit between the turned edge and the convex ring portion, thereby, it is ensured that the sleeve portion, the spiral portion, the inner body portion and the cup portion sleeved together achieve effective and stable sliding connections and gum-free assembly is achieved, and furthermore, the twisting force stability thereamong is further enhanced.

Second, in the lipstick tube cartridge of the present invention, the sleeve portion, the spiral portion, the inner body portion and the cup portion all are aluminum parts. That is, the entire cartridge is made from an all-aluminum material. In such a manner, the all-aluminum cartridge not only is more environmental-friendly than a conventional cartridge made from a plastic material, but also further meets a development direction of "de-plasticizing" in the future.

DETAILED DESCRIPTION OF THE EMBODIMENTS

Figure 1:
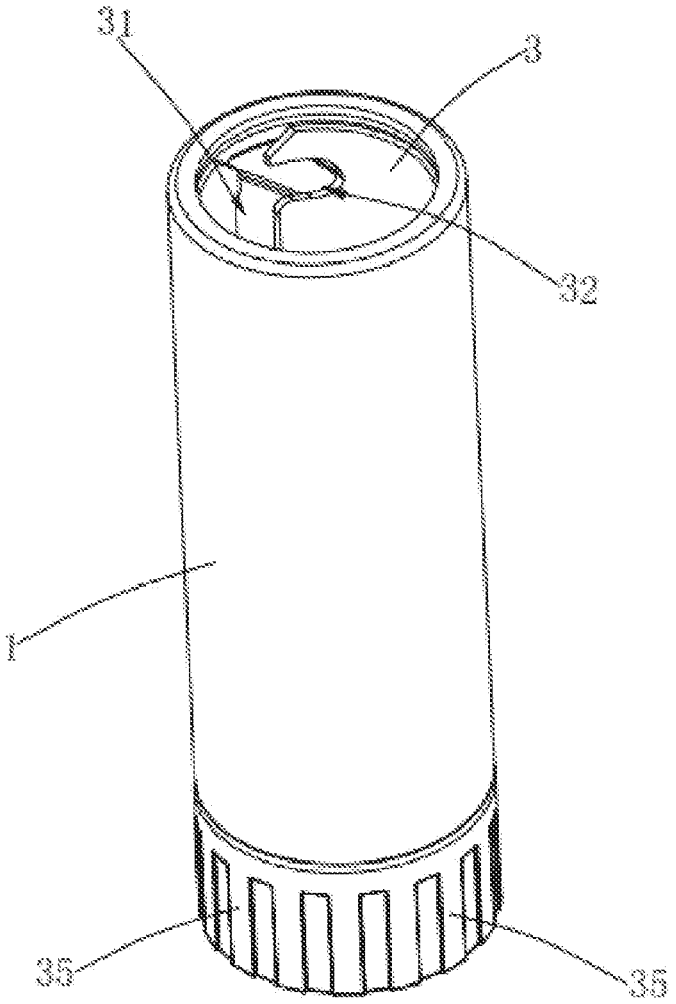
FIG. 1 is a structural schematic diagram of an all-aluminum lipstick tube cartridge in an embodiment of the present invention.

Further description of the present invention in detail will be made below in combination with drawings and embodiments.

The embodiment provides an all-aluminum lipstick tube cartridge. Specifically, referring to FIG. 1 to FIG. 6, the all-aluminum lipstick tube cartridge includes:

a sleeve portion 1 provided with a first cavity 10;

a spiral portion 2 sleeved in the first cavity 10 of the sleeve portion 1, the spiral portion 2 being provided with a second cavity 20, an inner side wall of the spiral portion 2 being formed with a helical spiral groove 21, a head end of the spiral groove 21 being located at the upper end of the spiral portion 2 and a tail end of the spiral groove 21 being located at the lower end of the spiral portion 2;

an inner body portion 3 sleeved in the second cavity 20 of the spiral portion 2, the inner body portion 3 being provided with a third cavity 30, a side wall of the inner body portion 3 being provided with a pair of oppositely formed guide slots 31 axially formed along the inner body portion, a head end and a tail end of each of the guide slots 31 being formed with a notch 32 communicated with the guide slot 31; and a cup portion 4 rotatably sleeved in the third cavity 30 of the inner body portion 3, the cup portion 4 being provided with a fourth cavity 40, an outer side wall of the cup portion 4 being provided with two convex pins 41, the convex pins 41 penetrating through the guide slots 31 in the same side and being slidably arranged in the spiral groove 21, the convex pins 41 being capable of sliding back and forth between the guide slots 31 and the corresponding notch 32, where the sleeve portion 1 and the inner body portion 3 are assembled together via sliding connection structures matched with each other. The sleeve portion 1, the spiral portion 2, the inner body portion 3 and the cup portion 4 in the embodiment are all aluminum parts. That is, the entire cartridge is made from an all-aluminum material. In such a manner, the all-aluminum cartridge not only is more environmental-friendly than a conventional cartridge made from a plastic material, but also further meets a development direction of "de-plasticizing" in the future. Furthermore, the all-aluminum cartridge structure in the embodiment can further avoid a machine polishing process, so that the processing difficulty of the cartridge is reduced, and dust pollution and potential safety hazard caused by a static electric fire in the machine polishing process are avoided.

Figure 5:
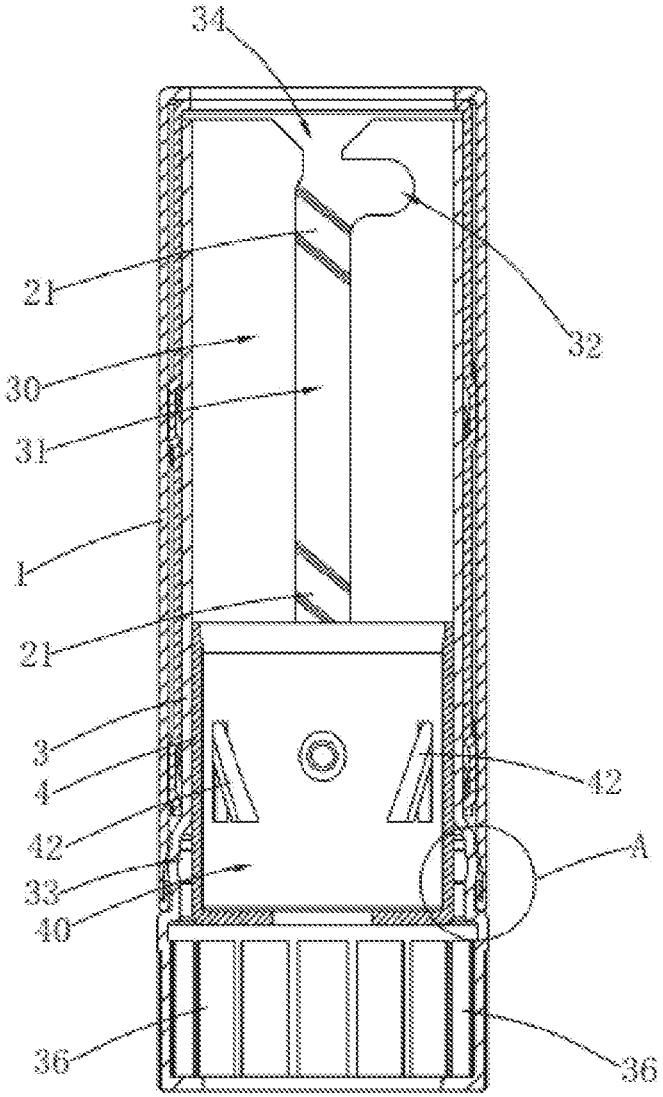
FIG. 5 is a section view of an all-aluminum lipstick tube cartridge shown in FIG. 1.
Figure 6:
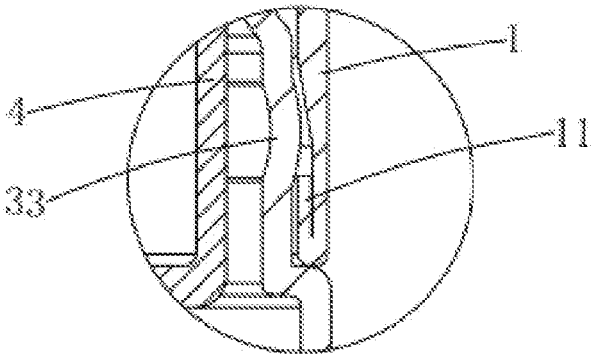
FIG. 6 is an enlarged schematic diagram of A in FIG. 5.
Figure 7:
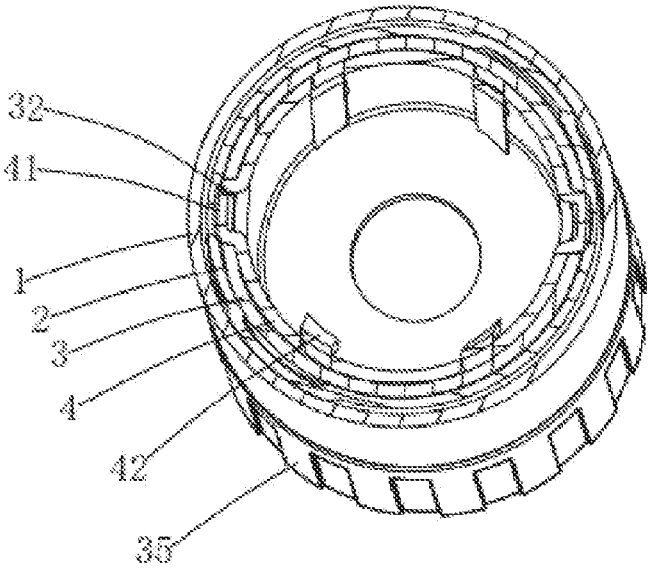
FIG. 7 is a section view of an all-aluminum lipstick tube cartridge shown in FIG. 1 in another view.
Figure 8:
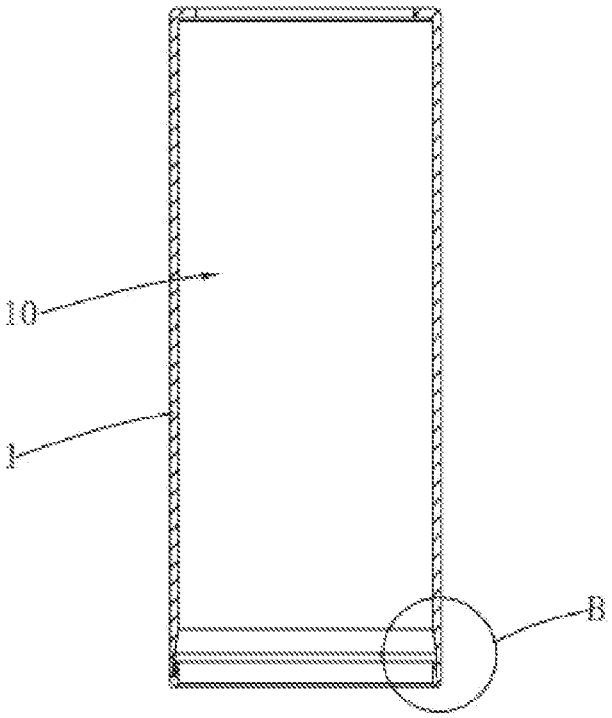
FIG. 8 is a section view of a sleeve portion.
Figure 9:
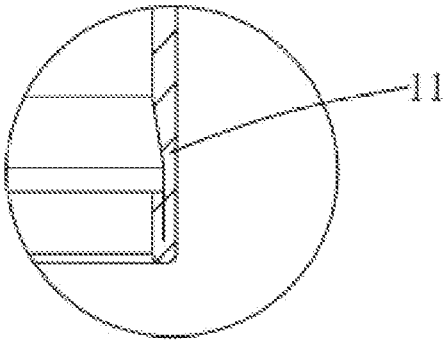
FIG. 9 is an enlarged schematic diagram of B in FIG. 8.
Figure 10:
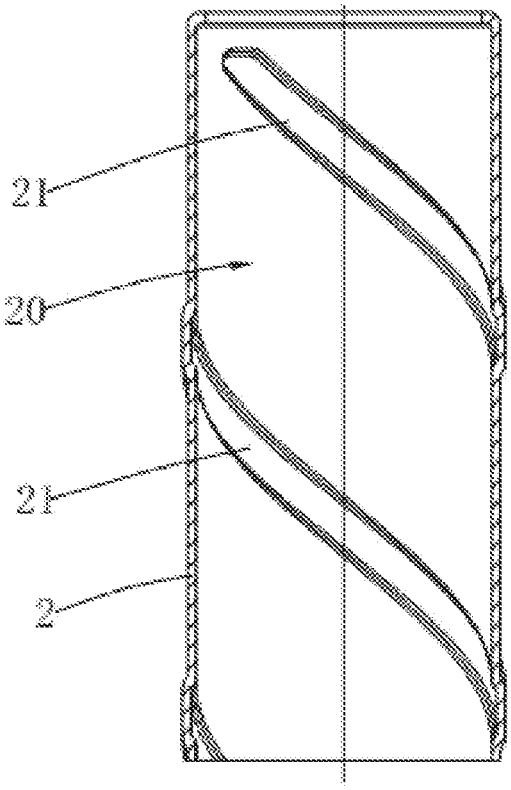
FIG. 10 is a section view of a spiral portion.
Figure 11:
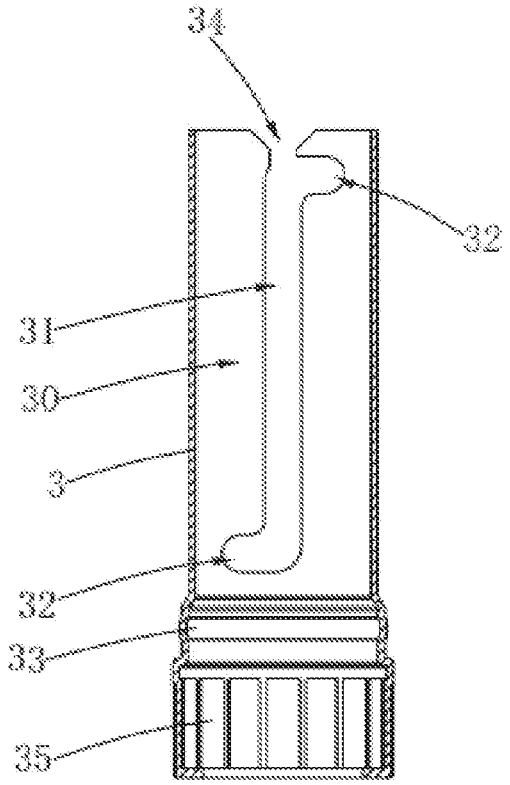
FIG. 11 is a section view of an inner body portion.
Figure 12:
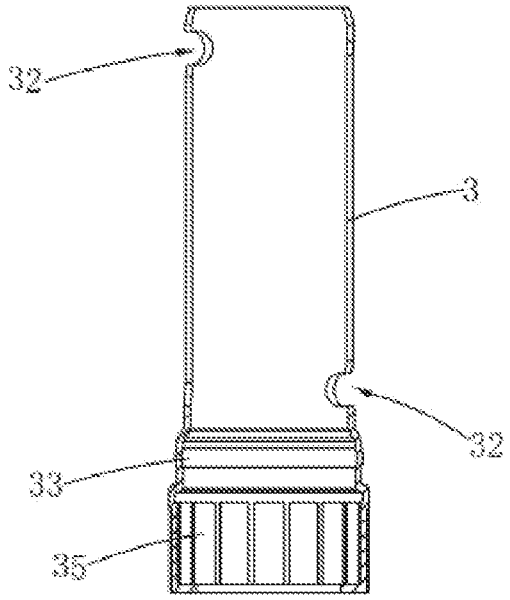
FIG. 12 is a section view of an inner body portion in another view.
Figure 13:
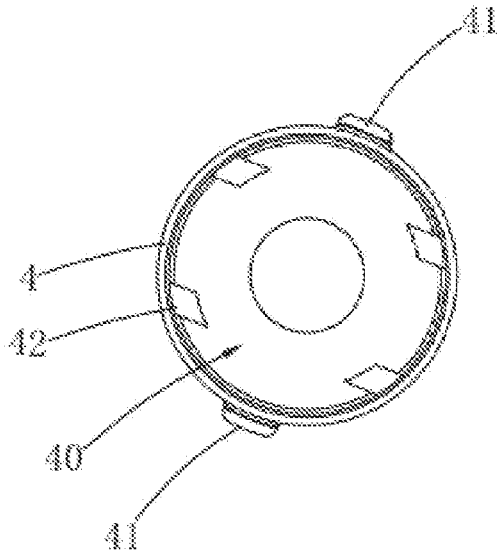
FIG. 13 is a section view of a cup portion.

Specifically, referring to FIG. 5 and FIG. 6, the lower end of the sleeve portion 1 is formed with a turned edge 11 turning toward the inner side of the first cavity 10, and the lower end of the inner body portion 3 is formed with a convex ring portion 33 in buckling fit with the turned edge 11, and the sleeve portion 1 and the inner body portion 3 achieve a sliding connection effect via the turned edge 11 and the convex ring portion 33 in buckling fit. The turned edge 11 is arranged herein, so that the sharp degree of a lower opening portion of the first cavity 10 can further be reduced greatly, so that the risk that a hand of a user is cut when the user takes a product is reduced. Certainly, a separating force can further be controlled effectively via the turned edge 11 and the convex ring portion 33 in buckling fit, and it is convenient to dismantle the sleeve portion and the inner body portion 3 in time.

In order to stretch the two convex pins 41 of the cup portion 4 into the guide slots 31 of the inner body portion 3 to meet an assembling requirement between the cup portion 4 and the inner body portion 3, referring to FIG. 4, FIG. 5, FIG. 11 and FIG. 12, the upper end of the inner body portion 3 is formed with two groove openings 34 adapted to slide the convex pins 41 on the corresponding sides respectively, and each of the groove openings 34 is communicated with the guide slot 31 in the same side. Therefore, during assembly, the convex pins 41 of the cup portion can enter the corresponding guide slots 31 via the groove openings 34, so that an assembling effect of the cup portion and the inner body portion is realized. In the embodiment, the guide slots 31 and the notches 32 respectively communicated with the guide slots 31 are integrally Z-shaped.

Figure 2:
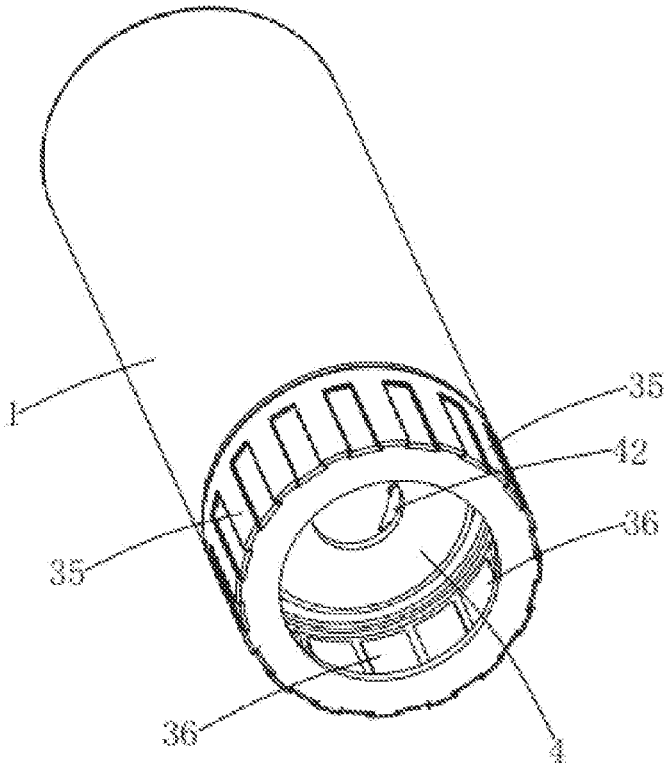
FIG. 2 is a schematic diagram of a bottom structure of an all-aluminum lipstick tube cartridge shown in FIG. 1.
Figure 3:
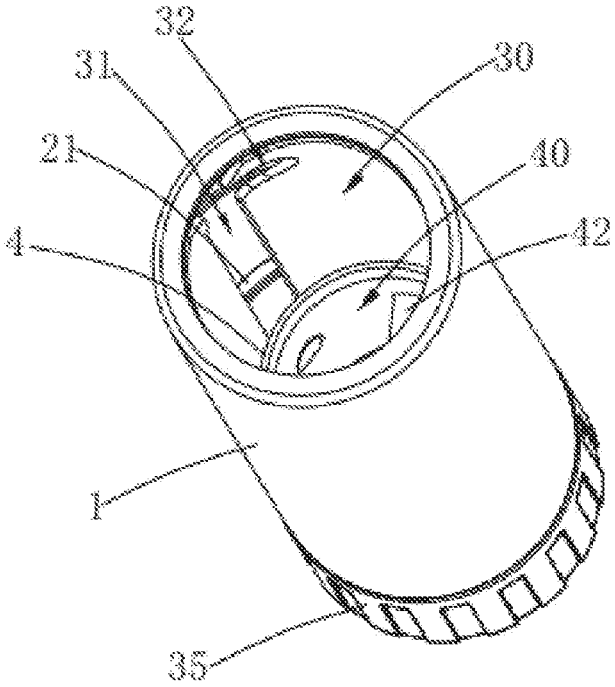
FIG. 3 is a schematic diagram of an all-aluminum lipstick tube cartridge shown in FIG. 1 in another view.
Figure 4:
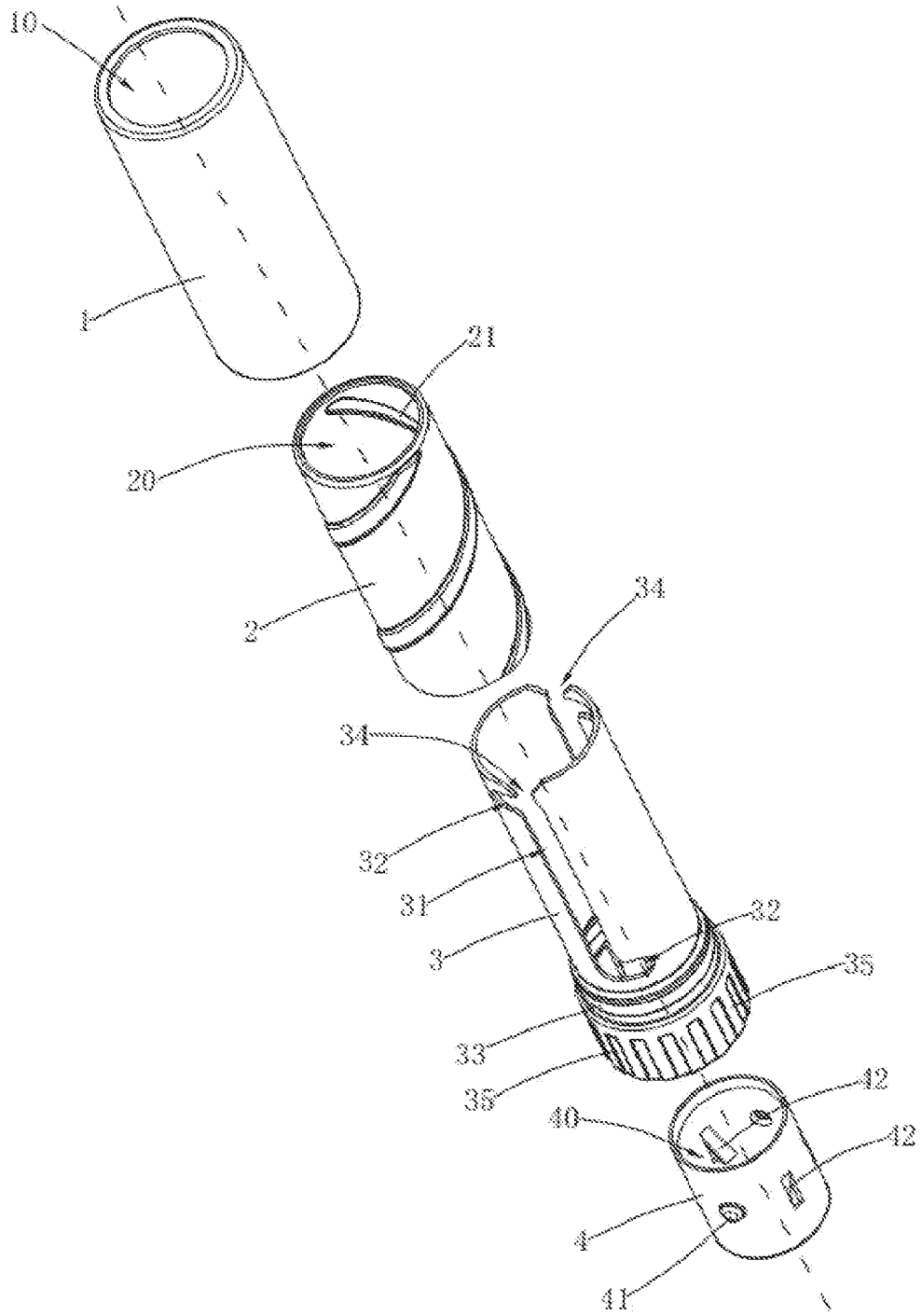
FIG. 4 is a schematic diagram of a breakdown structure of an all-aluminum lipstick tube cartridge shown in FIG. 1.

In order to stop rotation when the cartridge and other structures for assembling the lipstick tube are assembled in a gum-free manner, referring to FIG. 1 to FIG. 3, the outer side wall of the lower end of the inner body portion 3 of the embodiment is formed with several first rotation stopping ribs 35. Certainly, the inner side wall of the lower end of the inner body portion 3 can be formed with several second rotation stopping ribs 36 as needed.

In order to improve a grasping force of the cup portion to the lipstick paste so as to meet pouring requirements of different users on pastes with different hardness, referring to FIG. 3-5 and FIG. 7, in the embodiment, the inner wall on the cup portion 4 to form the fourth cavity 40 is provided with four inclined oblique ribs 42, the head end of each of the oblique ribs 42 is arranged on the inner side wall, and the tail end of each of the oblique ribs 42 is located in the fourth cavity 40. For example, in the embodiment, the oblique ribs 42 are directly formed on the inner side wall of the fourth cavity 40. The oblique ribs 42 herein can be of barb structures, which is favorable to enhance the grasping force to the past so as to prevent the paste from falling off.

The embodiment further provides a lipstick tube. Specifically, the lipstick tube of the embodiment applies the all-aluminum lipstick tube cartridge.

In the lipstick tube cartridge of the embodiment, the convex pins are arranged on the cup portion, are enable to penetrate through the corresponding guide slots and are arranged in the spiral groove in the corresponding side, so that sliding connections between the cup portion and the inner body portion and between the cup portion and the spiral portion are realized respectively. The sleeve portion and the cup portion realize a sliding connection assembling effect between the sleeve portion and the cup portion by buckling fit between the turned edge and the convex ring portion, thereby, it is ensured that the sleeve portion, the spiral portion, the inner body portion and the cup portion sleeved together achieve effective and stable sliding connections and gum-free assembly is achieved, and furthermore, the twisting force stability thereamong is further enhanced.

Although the preferred embodiments of the present invention are described in detail above, it is to be understood clearly that for those skilled in the art, various alternations and changes can be made on the present invention. Any modification, equivalent replacement, improvement, etc. made within the spirit and principle of the present invention shall be regarded as within the protection scope of the present invention.

What is claimed is:

1. An all-aluminum lipstick tube cartridge comprising:

a sleeve portion provided with a first cavity;

a spiral portion sleeved in the first cavity of the sleeve portion, the spiral portion being provided with a second cavity, an inner side wall of the spiral portion being formed with a helical spiral groove, a head end of the spiral groove being located at an upper end of the spiral portion and a tail end of the spiral groove being located at a lower end of the spiral portion;

an inner body portion sleeved in the second cavity of the spiral portion, the inner body portion being provided with a third cavity, a side wall of the inner body portion being provided with a pair of oppositely formed guide slots axially formed along the inner body portion, a head end and a tail end of each of the guide slots being formed with a notch communicated with the guide slot; and a cup portion rotatably sleeved in the third cavity of the inner body portion, the cup portion being provided with a fourth cavity, an outer side wall of the cup portion being provided with at least one convex pin, the at least one convex pin penetrating through the guide slot and being slidably arranged in the spiral groove, the convex pins being capable of sliding back and forth between the guide slot and the notch;

wherein the sleeve portion and the inner body portion are assembled together via sliding connection structures matched with each other, and the sleeve portion, the spiral portion, the inner body portion and the cup portion are all aluminum parts;

wherein a lower end of the sleeve portion is formed with a turned edge turning toward an inner side of the first cavity, and a lower end of the inner body portion is formed with a convex ring portion in buckling fit with the turned edge.

2. The all-aluminum lipstick tube cartridge of claim 1, wherein an inner side wall located on the cup portion and formed on the fourth cavity is provided with at least one inclined diagonal rib, a head end of the diagonal rib is arranged on the inner side wall, and a tail end of the diagonal rib is located in the fourth cavity.

3. The all-aluminum lipstick tube cartridge of claim 1, wherein an upper end of the inner body portion is formed with at least one groove opening where the convex pin slips into, and the groove opening is communicated with the guide slot.

4. The all-aluminum lipstick tube cartridge of claim 3, wherein an outer side wall of the lower end of the inner body portion is formed with several first rotation stopping ribs.

5. The all-aluminum lipstick tube cartridge of claim 4, wherein an inner side wall of the lower end of the inner body portion is formed with several second rotation stopping ribs.

6. The all-aluminum lipstick tube cartridge of claim 1, wherein the guide slots and the notches respectively communicated with the guide slots are integrally Z-shaped.

7. A lipstick tube, comprising the all-aluminum lipstick tube cartridge of claim 1.

* * * * *